US010890002B2

(12) United States Patent
Itagaki et al.

(10) Patent No.: US 10,890,002 B2
(45) Date of Patent: Jan. 12, 2021

(54) BINDING MACHINE

(71) Applicant: MAX CO., LTD., Tokyo (JP)

(72) Inventors: Osamu Itagaki, Tokyo (JP); Akira Kasahara, Tokyo (JP)

(73) Assignee: MAX CO., LTD., Tokyo (JP)

( * ) Notice: Subject to any disclaimer, the term of this patent is extended or adjusted under 35 U.S.C. 154(b) by 248 days.

(21) Appl. No.: 15/847,675

(22) Filed: Dec. 19, 2017

(65) Prior Publication Data

US 2018/0187435 A1 Jul. 5, 2018

(30) Foreign Application Priority Data

Dec. 29, 2016 (JP) ..... 2016-257447

(51) Int. Cl.
*E04G 21/12* (2006.01)

(52) U.S. Cl.
CPC ..... *E04G 21/123* (2013.01); *E04G 21/122* (2013.01)

(58) Field of Classification Search
CPC ..... E04G 21/123; E04G 21/122; B21F 9/02; B25B 25/00
See application file for complete search history.

(56) References Cited

U.S. PATENT DOCUMENTS

| | | | |
|---|---|---|---|
| 4,362,192 | A | 12/1982 | Furlong et al. |
| 9,132,472 | B2 | 9/2015 | Itagaki |
| 2006/0011254 | A1 | 1/2006 | Yokochi et al. |
| 2006/0157139 | A1 | 7/2006 | Hoyaukin |
| 2006/0283516 | A1* | 12/2006 | Nagaoka ..... E04G 21/122 140/119 |
| 2007/0199610 | A1 | 8/2007 | Itagaki |
| 2009/0283170 | A1 | 11/2009 | Nagaoka |
| 2009/0283172 | A1 | 11/2009 | Itagaki |
| 2014/0246115 | A1 | 9/2014 | Itagaki |
| 2015/0048194 | A1 | 2/2015 | Itagaki |
| 2015/0232212 | A1 | 8/2015 | Itagaki |
| 2016/0186451 | A1 | 6/2016 | Itagaki |
| 2016/0297555 | A1 | 10/2016 | Itagaki |

(Continued)

FOREIGN PATENT DOCUMENTS

| | | |
|---|---|---|
| CN | 2652552 Y | 11/2004 |
| CN | 1985058 A | 6/2007 |
| EP | 1 604 081 A1 | 12/2005 |

(Continued)

OTHER PUBLICATIONS

The extended European search report dated Apr. 26, 2018 in corresponding EP Patent Application No. 17208800.7 (7 pages).

(Continued)

*Primary Examiner* — Teresa M Ekiert
(74) *Attorney, Agent, or Firm* — Rothwell, Figg, Ernst & Manbeck, P.C.

(57) ABSTRACT

A binding machine includes a feeding unit configured to feed a wire and pull back the wire after winding the wire around an object to be bound, a binding unit configured to grip and twist the wire wound around the object with the feeding unit, a motor configured to rotatively drive the feeding unit, and a binding machine main body configured to accommodate therein the binding unit and the motor. The motor is arranged such that at least a part of the motor overlaps the binding unit, as seen from a side of the binding machine main body.

5 Claims, 3 Drawing Sheets

(56) References Cited

U.S. PATENT DOCUMENTS

2017/0305584 A1 10/2017 Itagaki

FOREIGN PATENT DOCUMENTS

| | | | |
|---|---|---|---|
| EP | 2 029 834 | A1 | 3/2009 |
| EP | 2 123 847 | A2 | 11/2009 |
| JP | 6-48411 | A | 2/1994 |
| JP | H07-004048 | A | 1/1995 |
| JP | 2004-142813 | A | 5/2004 |
| JP | 2008-291642 | A | 12/2008 |
| JP | 2009-275485 | A | 11/2009 |
| JP | 5045549 | B2 | 10/2012 |
| TW | 201008834 | A1 | 3/2010 |
| WO | 2004/083559 | A1 | 9/2004 |
| WO | 2007/141822 | A1 | 12/2007 |

OTHER PUBLICATIONS

Office Action issued in corresponding Japanese Patent Application No. 2016-257447 dated Jun. 9, 2020, (3 pages).

* cited by examiner

BINDING MACHINE

CROSS-REFERENCE TO RELATED APPLICATION

This application claims the priority from Japanese Patent Application No. 2016-257447 filed on Dec. 29, 2016, the entire contents of which are incorporated herein by reference.

FIELD

The present disclosure relates to a binding machine.

BACKGROUND

In the related art, a reinforcing bar binding machine has been widely used which includes a feeding unit configured to bend a wire into a loop shape, to wind the wire around reinforcing bars and to pull back the wire, and a twisting mechanism configured to bind the reinforcing bars by twisting the wire wound around the reinforcing bars. Also, in recent years, a reinforcing bar binding machine configured to bind the reinforcing bars with two or more wires has been developed.

According to the reinforcing bar binding machine, in general, a magazine in which the wire is accommodated is provided in front of a handle part, and a feeding mechanism including a feeding gear and a feeding motor configured to rotatively drive the feeding gear is provided above the magazine. For example, JP-A-2004-142813 discloses a reinforcing bar binding machine in which a feeding gear configured by a spur gear is provided above a magazine and a feeding motor is provided at a side of the feeding gear.

However, the reinforcing bar binding machine disclosed in JP-A-2004-142813 and the like has following problems. That is, according to the reinforcing bar binding machine, since the magazine is arranged below the feeding motor, the magazine largely protrudes downward from a binding machine main body. For this reason, the magazine protruding from the binding machine main body may interfere an operation at a narrow place, so that the operation efficiency is lowered.

Also, according to the reinforcing bar binding machine, a trigger is provided at a position avoiding the feeding motor. For this reason, the trigger is arranged at a position distant from a guide unit (arm) in which an object to be bound such as reinforcing bars is to be inserted. As a result, when performing a trigger operation, it is difficult to correctly insert the object to be bound into the guide unit.

The present disclosure has been made in view of the above situations, and an object thereof is to provide a binding machine capable of improving the operation efficiency at an operation place.

A binding machine of the present disclosure includes a feeding unit configured to feed a wire and pull back the wire after winding the wire around an object to be bound, a binding unit configured to grip and twist the wire wound around the object with the feeding unit, a motor configured to rotatively drive the feeding unit, and a binding machine main body configured to accommodate therein the binding unit and the motor, wherein the motor is arranged such that at least a part of the motor overlaps with the binding unit, as seen from a side of the binding machine main body.

Also, a binding machine of the present disclosure includes a feeding unit configured to feed a wire and pull back the wire after winding the wire around an object to be bound, a binding unit configured to grip and twist the wire wound around the object with the feeding unit, a motor configured to rotatively drive the feeding unit, and a binding machine main body configured to accommodate therein the binding unit and the motor, wherein the motor is arranged at a side of the binding unit in the binding machine main body.

The binding machine may further include a handle part extending from the binding machine main body in a direction intersecting with a rotary shaft of the binding unit, and a trigger provided to the handle part and configured to be pressed by an operator, wherein the trigger mat be arranged at a position which does not overlap with a line perpendicular to the rotary shaft of the binding unit and passing through the motor, as seen from a side of the binding machine main body.

According to the present disclosure, since the motor is provided to two-dimensionally overlap with the binding machine main body or the motor is provided at a side of the binding unit in the binding machine main body, the motor can be provided at a position close to the binding unit. Thereby, since it is possible to arrange the magazine, in which the wire is to be accommodated, at a position closer to the feeding unit, as compared to the related-art configuration, it is possible to miniaturize the reinforcing bar binding machine as a whole.

DETAILED DESCRIPTION

Hereinafter, embodiments of the present disclosure will be described in detail with reference to the accompanying drawings.

[Example of Sectional Configuration of Reinforcing Bar Binding Machine 1A]

Figure 1:
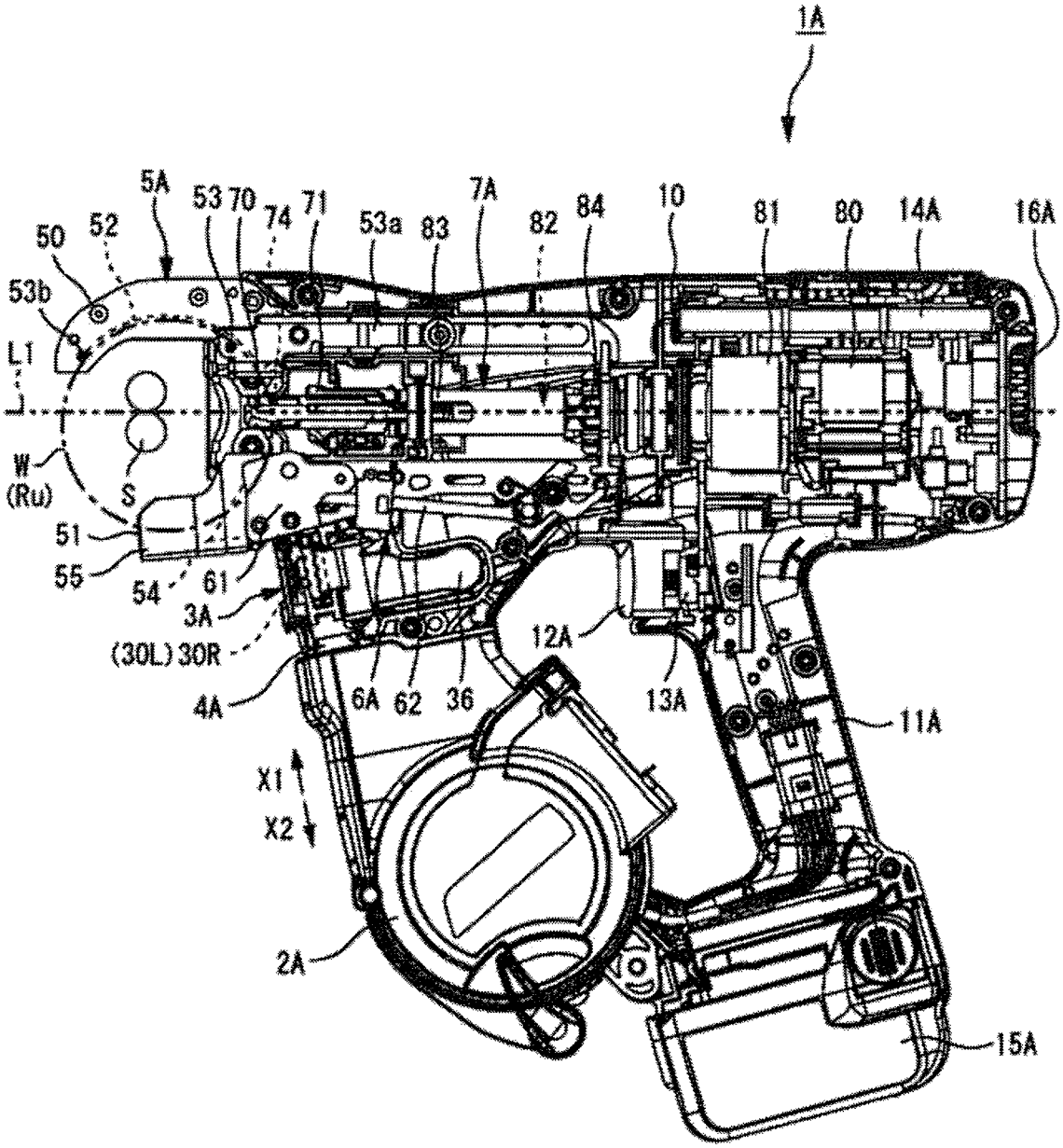
FIG. 1 is a view depicting an example of a section in a front and back direction of a reinforcing bar binding machine according to an embodiment of the present disclosure.

FIG. 1 is a view depicting an example of a section of a reinforcing bar binding machine 1A according to an embodiment of the present disclosure. In the reinforcing bar binding machine 1A of FIG. 1, a left side of the drawing sheet is referred to as a front side of the reinforcing bar binding machine 1A, a right side of the drawing sheet is referred to as a rear side of the reinforcing bar binding machine 1A, an upper side of the drawing sheet is referred to as an upper side of the reinforcing bar binding machine 1A, and a lower side of the drawing sheet is referred to as a lower side of the reinforcing bar binding machine 1A.

As shown in FIG. 1, the reinforcing bar binding machine 1A includes a binding machine main body 10, a handle part 11A, a magazine 2A, which is an accommodation unit configured to accommodate therein a wire W, a wire feeding unit (feeding unit) 3A configured to feed the wire W accommodated in the magazine 2A, and a guide unit 4A configured to guide the wire W to be fed into the wire feeding unit 3A and the wire W to be fed from the wire feeding unit 3A. Further, the reinforcing bar binding machine 1A includes a curl guide unit 5A configured to wind the wire W to be fed from the wire feeding unit 3A around reinforcing bars S, and a cutting unit 6A configured to cut the wire W wound around the reinforcing bars S. Further, the reinforcing bar binding machine 1A includes a twisting mechanism (binding unit) 7A configured to grip and twist the wire W wound around the reinforcing bars S.

The binding machine main body 10 is configured by a case having an elongated tubular shape extending in a front and back direction (a front and back direction when a side (one end side) to which the curl guide unit 5A is provided is referred to as a forward direction and an opposite side (the other end side) thereto is referred to as a back direction), and has a halved structure that can be divided at right and left sides of the reinforcing bar binding machine 1A. In the binding machine main body 10, the twisting mechanism 7A, and the like are mounted at predetermined positions. The curl guide unit 5A is mounted to a front part (one end portion in a longitudinal direction) of the binding machine main body 10.

The handle part 11A is configured to be gripped by an operator and extends from a lower surface of a slightly rear side of a center portion of the binding machine main body 10 toward a direction perpendicular to (intersecting with) or substantially perpendicular to an axis L1. The axis L1 is a virtual line extending on an axis (in the front and back direction in the binding machine main body 10) of a rotary shaft 82 (refer to FIG. 3) provided in the binding machine main body 10. A trigger 12A with which the operator operates the reinforcing bar binding machine 1A is provided in the vicinity of a boundary with the binding machine main body 10 at a front side part of the handle part 11A. The arrangement position of the handle part 11A will be described in detail later.

A switch 13A is provided in the handle part 11A at the rear of the trigger 12A. The switch 13A is configured to be turned on and to operate a twisting motor 80 and the like in accordance with an operator's pressing operation on the trigger 12A. A battery 15A is detachably mounted to a lower part of the handle part 11A.

In the magazine 2A, a reel 20 on which the long wire W is wound to be reeled out is detachably accommodated. In the reinforcing bar binding machine 1A, while the reel 20 accommodated in the magazine 2A is rotated, the wire W is reeled out from the reel 20 during an operation of feeding the wire W with the wire feeding unit 3A and during an operation of manually feeding the wire W.

The wire feeding unit 3A includes, as a pair of feeding members configured to feed the wires W, a first feeding gear 30L having a spur gear shape and configured to feed the wire W by a rotating operation, and a second feeding gear 30R having a spur gear shape and configured to sandwich the wires W between the first feeding gear 30L and the second feeding gear 30R, and also includes a feeding motor 32 configured to rotatively drive the first feeding gear 30L and the second feeding gear 30R. The first feeding gear 30L and the second feeding gear 30R have a spur gear shape having a tooth part formed on an outer peripheral surface of a circular plate-shaped member, respectively. Meanwhile, in FIG. 1, the first feeding gear 30L is located at a back side of the first feeding gear 30R with respect to the drawing sheet.

The wire feeding unit 3A is configured such that the first feeding gear 30L and the second feeding gear 30R are provided with a feeding path of the wires W being interposed therebetween and thus the outer peripheral surfaces of the first feeding gear 30L and the second feeding gear 30R face each other. The first feeding gear 30L and the second feeding gear 30R are configured to sandwich the wire W between the facing portions of the outer peripheral surfaces. The first feeding gear 30L and the second feeding gear 30R are configured to feed the wire W along the extension direction of the wire W.

The wire feeding unit 3A is configured such that the rotation directions of the first feeding gear 30L and the second feeding gear 30R are switched and the feeding direction of the wire W is switched between the forward and reverse directions by switching a rotation direction of the feeding motor 32 between the forward and reverse directions.

In the reinforcing bar binding machine 1A, the first feeding gear 30L and the second feeding gear 30R are rotated in the forward direction with the wire feeding unit 3A such that the wire W is fed in a forward direction denoted with an arrow X1, i.e., toward the curl guide unit 5A and is then wound around the reinforcing bars S with the curl guide unit 5A. After winding the wire W around the reinforcing bars S, the first feeding gear 30L and the second feeding gear 30R are rotated in the reverse direction, so that the wire W is fed (pulled back) in a reverse direction denoted with an arrow X2, i.e., toward the magazine 2A. The wire W is wound around the reinforcing bars S and is then pulled back, so that the wire W is closely contacted to the reinforcing bars S.

The feeding motor 32 is connected to the first feeding gear 30L and the second feeding gear 30R via a plurality of gears each of which is configured by a spur gear and is configured to rotate the first feeding gear 30L and the second feeding gear 30R in the forward and reverse directions. The spur gears are used as the gears for connecting feeding motor 32, the first feeding gear 30L and the like, so that it is possible to arrange the feeding motor 32 at a position closer to the twisting mechanism 7A, as compared to the related-art configuration. That is, it is possible to arrange the feeding motor 32 at a position slightly higher than the first feeding gear 30L and the like in the binding machine main body 10. The arrangement position and the like of the feeding motor 32 will be described in detail later.

The wire feeding unit 3A includes a second displacement member 36 provided between the first feeding gear 30L and second feeding gear 30R and the handle part 11A. The wire feeding unit 3A is configured to displace the first feeding gear 30L and the second feeding gear 30R in directions of coming close to and separating from each other. An operation button (not shown) configured to displace the second displacement member 36 is attached to the second displacement member 36.

The guide unit 4A is provided between the magazine 2A and the first feeding gear 30L and second feeding gear 30R. The guide unit 4A is configured to regulate a direction of one or more fed wires W (while aligning the wires W in parallel when a plurality of wires W is fed) and to deliver the wires W. The guide unit 4A may be provided downstream of the first feeding gear 30L and the second feeding gear 30R with respect to the arrow X1 direction.

The curl guide unit 5A includes a first guide part 50 configured to curl the wires W to be fed by the first feeding gear 30L and the second feeding gear 30R and a second guide part 51 configured to guide the wires W fed from the first guide part 50 toward the twisting mechanism 7A.

The first guide part 50 has a guide groove 52 configuring a feeding path of the wire W and guide pins 53, 53*b* as a guide member configured to curl the wire W in cooperation with the guide groove 52.

The guide groove 52 is configured to regulate a direction of the wires W in a radial direction perpendicular to the feeding direction of the wires W together with the guide unit 4A.

The guide pin 53 is provided at an introduction part-side of the first guide part 50, to which the wire W being fed by the first feeding gear 30L and the second feeding gear 30R are introduced. The guide pin 53 is arranged at a radially inner side of a loop Ru to be formed by the wire W with respect to the feeding path of the wire W configured by the guide groove 52. The guide pin 53 is configured to regulate the feeding path of the wire W such that the wire W being fed along the guide groove 52 do not enter the radially inner side of the loop Ru to be formed by the wire W.

The guide pin 53*b* is provided at a discharge part-side of the first guide part 50, from which the wire W being fed by the first feeding gear 30L and the second feeding gear 30R is discharged, and is arranged at a radially outer side of the loop Ru to be formed by the wire W with respect to the feeding path of the wire W configured by the guide groove 52.

The wire W that is fed by the first feeding gear 30L and the second feeding gear 30R is curled as a radial position of the loop Ru to be formed by the wire W is regulated at least at three points of two points of the radially outer side of the loop Ru formed by the wires W and one point of the radially inner side between the two points.

In this example, a radially outer position of the loop Ru to be formed by the wire W is regulated at two points of the guide unit 4A provided upstream of the guide pin 53 and the guide pin 53*b* provided downstream of the guide pin 53 with respect to the feeding direction of the wire W that is fed in the forward direction. A radially inner position of the loop Ru to be formed by the wires W is regulated by the guide pin 53.

The curl guide unit 5A includes a retraction mechanism 53*a* configured to retract the guide pin 53 from a moving path of the wire W during an operation of winding the wire W on the reinforcing bars S. The retraction mechanism 53*a* is configured to be displaced in conjunction with the operation of the twisting mechanism 7A after the wire W is wound around the reinforcing bars S and to retract the guide pin 53 from the moving path of the wire W before the wire W is wound on the reinforcing bars S.

The second guide part 51 has a fixed guide part (third guide part) 54 configured to regulate a radial position (movement of the wire W in the radial direction of the loop Ru) of the loop Ru to be formed by the wire W to be wound around the reinforcing bars S and a moveable guide part (fourth guide part) 55 configured to regulate a position (movement of the wire W in an axial direction Ru1 of the loop Ru) along the axial direction Ru1 of the loop Ru to be formed by the wire W to be wound around the reinforcing bars S.

The fourth guide part 55 is opened and closed between a guide position at which it can guide the wire delivered from the first guide part 50 toward the second guide part 51 and a retraction position at which it is retracted during an operation of pulling out the reinforcing bar binding machine 1A from the reinforcing bars S by a rotating operation about a shaft, which is a support point.

The cutting unit 6A includes a fixed blade part (not shown), a rotary blade part 61 configured to cut the wire W in cooperation with the fixed blade part, and a transmission mechanism 62 configured to transmit an operation of the twisting mechanism 7A to the rotary blade part 61. The rotary blade part 61 is configured to cut the wire W, which is to pass through the guide unit 4A of the fixed blade part, by a rotating operation about a shaft, which is a support point. The transmission mechanism 62 is configured to be displaced in conjunction with the operation of the twisting mechanism 7A and to rotate the rotary blade part 61 in conformity to timing at which the wire W is to be twisted after the wire W is wound on the reinforcing bars S, thereby cutting the wires W.

The twisting mechanism 7A includes a gripping part 70 configured to grip the wire W, a bending part (bending portion) 71 configured to bend one end portion WS and the other end portion WE of the wire W toward the reinforcing bars S, a length regulation part 74 configured to regulate a position of one end portion WS of the wire W, a twisting motor 80, a rotary shaft 82 configured to be driven by the twisting motor 80 via a decelerator 81 for deceleration and torque amplification, a moveable member 83 configured to be displaced by a rotating operation of the rotary shaft 82, and a rotation regulation member 84 configured to regulate rotation of the moveable member 83 coupled to the rotating operation of the rotary shaft 82. The rotary shaft 82 of the twisting mechanism 7A is arranged along a longitudinal direction (front and back direction) of the elongated binding machine main body 10 and is arranged at a substantially center portion of a section in the right and left direction of the binding machine main body 10.

The gripping part 70 includes a fixed gripping member 70C, a first moveable gripping member 70L, and a second moveable gripping member 70R (refer to FIG. 3). The first moveable gripping member 70L and the second moveable gripping member 70R are arranged at left and right sides with the fixed gripping member 70C being interposed therebetween. Specifically, the first moveable gripping member 70L is arranged at one side along the axial direction of the wire W to be wound and the second moveable gripping member 70R is arranged at the other side, with respect to the fixed gripping member 70C.

The bending part 71 is configured to bend the wire W such that the end portion of the wire W bound on the object to be bound are located closer to the object to be bound than the top of the wire W most protruding in a direction of getting away from the object to be bound. The bending part 71 is configured to bend the wire W gripped with the gripping part 70, before twisting the wire W by the gripping part 70.

The length regulation part 74 includes a member, to which the one end portion WS of the wire W is to be butted, on the feeding path of the wire W having passed between the fixed gripping member 70C and the first moveable gripping member 70L. In this example, the length regulation part 74 is provided to the first guide part 50 of the curl guide unit 5A so as to secure a predetermined distance from a gripping position of the wire W by the fixed gripping member 70C and the first moveable gripping member 70L.

The rotary shaft 82 and the moveable member 83 are configured such that the rotating operation of the rotary shaft 82 is converted into movement in a front and back direction along the rotary shaft 82 of the moveable member 83 by a screw part provided to the rotary shaft 82 and a nut part provided to the moveable member 83. The twisting mechanism 7A is provided integrally with the moveable member 83, so that the movement of the moveable member 83 in the front and back direction causes the twisting mechanism 7A to move in the front and back direction.

In an operation area in which the wire W is gripped by the gripping part 70 and the wire W are bent by the bending part 71, the moveable member 83 and the bending part 71 are engaged with the rotation regulation member 84, and are thus moved in the front and back direction with the rotating operation being regulated by the rotation regulation member 84. Also, when the moveable member 83 and the bending part 71 are disengaged from the rotation regulation member 84, they are rotated by the rotating operation of the rotary shaft 82.

The reinforcing bar binding machine 1A includes a control unit 14A. The control unit 14A is configured to supply power to the twisting motor 80, the feeding motor 32 and the like, and to control the respective operations of the twisting motor 80 and the like. The control unit 14A is mounted above the twisting mechanism 7A, and each wiring thereof is pulled out toward the twisting mechanism 7A.

A rear part (a backside part) of the binding machine main body 10 is provided with an operation unit 16A. The operation unit 16A includes a torque adjustment dial for adjusting fastening torque of the wires W, a switch for switching on and off states of a power supply of the reinforcing bar binding machine 1A, and an LED configured to be lighted on the basis of the on and off states of the switch or the like. The operation unit 16A is connected to the control unit 14A via a wiring (not shown).

[Example of Arrangement of Feeding Motor 32 and the Like]

Figure 2:
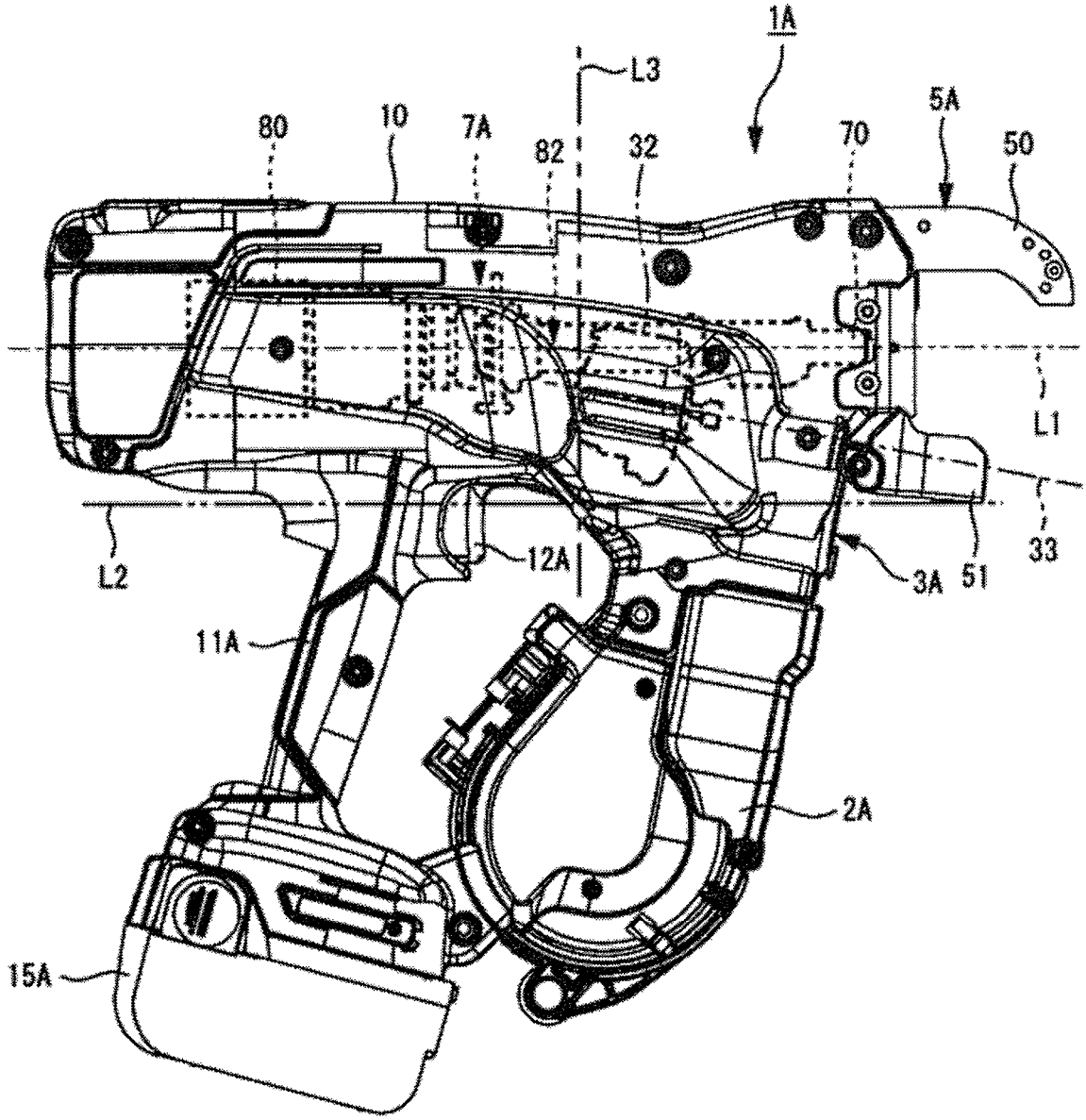
FIG. 2 is a side view depicting an example of a right side of the reinforcing bar binding machine.

FIG. 2 is a view for illustrating a relation between an arrangement position of the feeding motor 32 and an arrangement position of the twisting mechanism 7A. In the reinforcing bar binding machine 1A of FIG. 2, a right side of the drawing sheet is referred to as a front side of the reinforcing bar binding machine 1A, a left side of the drawing sheet is referred to as a rear side of the reinforcing bar binding machine 1A, an upper side of the drawing sheet is referred to as an upper side of the reinforcing bar binding machine 1A, and a lower side of the drawing sheet is referred to as a lower side of the reinforcing bar binding machine 1A.

As shown in FIG. 2, the feeding motor 32 is arranged to overlap with the twisting mechanism 7A, as seen from a side of the reinforcing bar binding machine 1A (as seen two-dimensionally). Specifically, an upper part side of the feeding motor 32 is arranged to overlap the rotary shaft 82 of the twisting mechanism 7A, as seen from a side of the reinforcing bar binding machine 1A. The overlapping position of the feeding motor 32 over the twisting mechanism 7A is not limited to the upper part side of the feeding motor 32, and at least a part of the feeding motor 32 may overlap the twisting mechanism 7A or the axis L1 thereof. Also, the feeding motor 32 is arranged above a virtual line L2 passing through a lower surface (the lowest end portion) at a guide position of the second guide part 51 and extending in parallel with the rotary shaft 82 of the twisting mechanism 7A.

The feeding motor 32 is arranged at a position, which is close to a side in a section in the right and left direction of the binding machine main body 10, in the case configuring the binding machine main body 10 such that at least a part thereof two-dimensionally overlaps the twisting mechanism 7A arranged at a substantially center part of the section. That is, the feeding motor 32 and the twisting mechanism 7A are provided to be adjacent in the right and left direction, as seen from the front and rear direction of the binding machine main body 10. In this case, a side part of the case of the binding machine main body 10 may be provided with an accommodation part protruding outward so as to conform to a shape of the feeding motor 32, and the feeding motor 32 may be mounted in the accommodation part. The outer shape of the binding machine main body 10 is not limited to the above shape, and any shape may be appropriately adopted as long as the feeding motor 32 can be arranged at a side in the binding machine main body 10. Thereby, it is possible to arrange the feeding motor 32 at a higher position in the binding machine main body 10, as compared to the related-art configuration.

Subsequently, a positional relation between the feeding motor 32 and the trigger 12A is described. The trigger 12A is arranged at a position slightly displaced toward the rear side from a position just below the feeding motor 32. In other words, the trigger 12A is arranged at a position located on the virtual line L2 and displaced toward the rear side from a virtual line L3 perpendicular to the rotary shaft 82 of the twisting mechanism 7A and passing through the feeding motor 32. The feeding motor 32 is arranged at the twisting mechanism 7A-side in this way, so that it is possible to arrange the trigger 12A at a position close to the curl guide unit 5A.

A motor rotary axis 33 of the feeding motor 32 is arranged in the substantially same direction as the rotary shaft 82 of the twisting mechanism 7A as seen in a side of the reinforcing bar binding machine 1A.

Further, the upper part of the feeding motor 32 with respect to the motor rotary axis 33 overlaps with the rotary shaft 82 of the twisting mechanism 7A as seen in a side of the reinforcing bar binding machine 1A.

[Example of Operation of Reinforcing Bar Binding Machine 1A]

Subsequently, an example of the operation of the reinforcing bar binding machine 1A, which is performed when binding the reinforcing bars S with the wires W, is described with reference to FIGS. 1 and 3A to 3D. FIGS. 3A to 3D are views for illustrating an example of an operation of gripping and twisting the wire W.

Figure 3A:
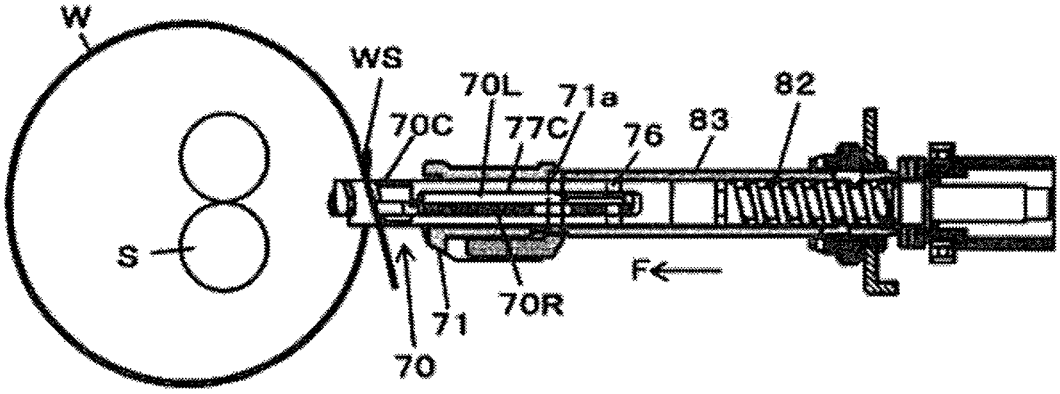
FIGS. 3A to 3D depict an example of an operation of the reinforcing bar binding machine when winding a wire on reinforcing bars and twisting the same.

As shown in FIGS. 1 and 3A, when two wires W are fed in the forward direction from the magazine 2A by the first feeding gear 30L and the second feeding gear 30R, the wires W pass between the fixed gripping member 70C and the second moveable gripping member 70R, and pass through the guide groove 52 of the first guide part 50 of the curl guide unit 5A. Thereby, the wires W are curled to be wound around the reinforcing bars S.

The wires W delivered from the first guide part 50 are guided to the third guide part 54 with the movement being regulated by the fourth guide part 55 of the second guide part 51. The wires W guided to the third guide part 54 are prevented from moving along the radial direction of the loop Ru by the third guide part 54 and is guided between the fixed gripping member 70C and the first moveable gripping member 70L. Then, the tip ends of the wires W are butted to the length regulation part 74. Thereby, the wires W are wound in a loop shape around the reinforcing bars S.

Figure 3B:
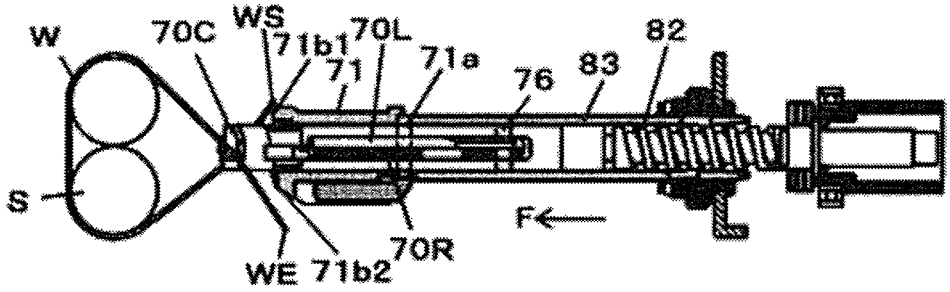

As shown in FIG. 3B, after stopping the feeding of the wires W, the twisting motor 80 is driven in the forward rotation direction, so that the twisting motor 80 moves the moveable member 83 in the arrow F direction, which is a forward direction. That is, a rotating operation of the moveable member 83 coupled to the rotation of the twisting motor 80 is regulated by the rotation regulation member 84, so that the rotation of the twisting motor 80 is converted into the linear movement. Thereby, the moveable member 83 is moved forward. In conjunction with the forward movement of the moveable member 83, the bending part 71 is moved forward, so that the first moveable gripping member 70L is moved in a direction of coming close to the fixed gripping member 70C by a rotating operation about a shaft 76, which is a support point. Thereby, one end portions WS of the wires W are gripped.

Also, the second moveable gripping member 70R is moved in the direction of coming close to the fixed gripping member 70C by a rotating operation about the shaft 76, which is a support point. The second moveable gripping member 70R is moved in the direction of coming close to the fixed gripping member 70C, so that the wires W are supported in the extension direction.

Also, the forward moving operation of the moveable member 83 is transmitted to the retraction mechanism 53*a*, so that the guide pin 53 is retracted from the moving path of the wires W. After gripping one end portions WS of the wires W between the first moveable gripping member 70L and the fixed gripping member 70C, the feeding motor 32 is driven in the reverse rotation direction, so that the first feeding gear 30L is reversely rotated and the second feeding gear 30R is also reversely rotated in conjunction with the first feeding gear 30L. Thereby, the two wires W are pulled back toward the magazine 2A, and are fed in the reverse direction. During the operation of feeding the wires W in the reverse direction, the wires W are wound on the reinforcing bars S with being closely contacted thereto.

After winding the wires W on the reinforcing bars S and stopping the feeding of the wires W, the twisting motor 80 is driven in the forward rotation direction, so that the moveable member 83 is moved forward. The forward moving operation of the moveable member 83 is transmitted to the cutting unit 6A by the transmission mechanism 62, so that the other end portions WE of the wires W gripped with the second moveable gripping member 70R and the fixed gripping member 70C are cut by the operation of the rotary blade part 61.

As shown in FIG. 3B, after cutting the wires W, the moveable member 83 is further moved forward, so that the bending part 71 is moved forward integrally with the moveable member 83.

Figure 3C:
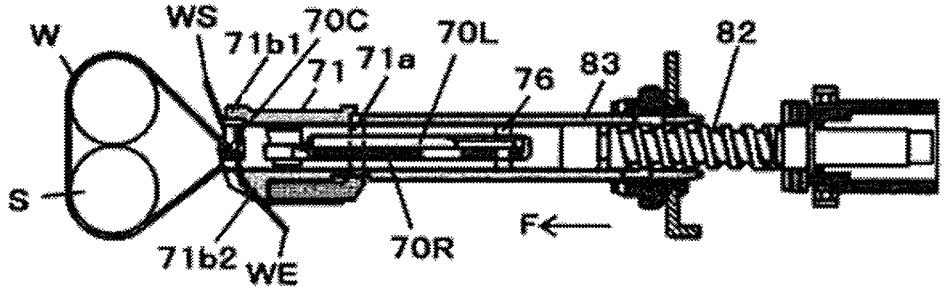

As shown in FIG. 3C, the bending part 71 is moved in the forward direction denoted with the arrow F by a predetermined distance, so that one end portions WS of the wires W gripped with the fixed gripping member 70C and the first moveable gripping member 70L are pressed toward the reinforcing bars S by a bending portion 71*b*1, and are thus bent toward the reinforcing bars S at the gripping position, which is a support point. Also, the bending part 71 is further moved forward, so that an opening and closing pin 71*a* is moved in an opening and closing guide hole 77R. Thereby, a gap in which one end portions WE of the wires W are fed is formed between the second moveable gripping member 70R and the fixed gripping member 70C.

Also, the bending part 71 is moved in the forward direction denoted with the arrow F by a predetermined distance, so that the other end portions WE of the wires W gripped with the fixed gripping member 70C and the second moveable gripping member 70R are pressed toward the reinforcing bars S by a bending portion 71*b*2, and are thus bent toward the reinforcing bars S at the gripping position, which is a support point.

Figure 3D:
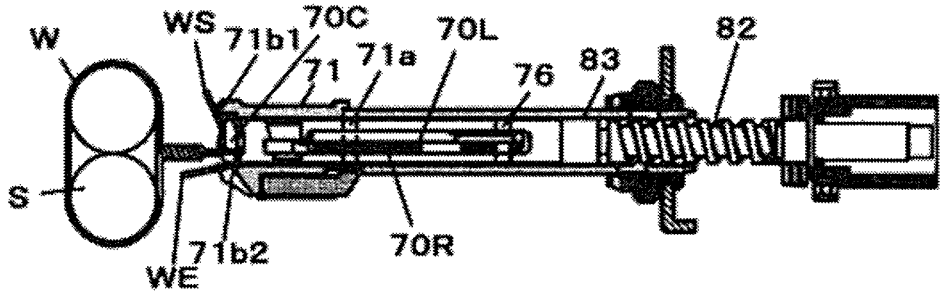

As shown in FIG. 3D, after bending the end portions of the wires W toward the reinforcing bars S, the twisting motor 80 is further driven in the forward rotation direction, so that the twisting motor 80 further moves the moveable member 83 in the forward direction denoted with the arrow F. The moveable member 83 is moved to a predetermined position in the arrow F direction, so that the moveable member 83 is disengaged from the rotation regulation member 84 and the rotation regulation state of the moveable member 83 by the rotation regulation member 84 is released. Thereby, the twisting motor 80 is further driven in the forward rotation direction, so that the gripping part 70 gripping the wires W is rotated and twists the wires W. The gripping part 70 is urged backward by a spring (not shown), so that it twists the wires W while applying tension thereto. Therefore, the wires W are not loosened, and the reinforcing bars S are bound with the wires W.

As described above, according to the embodiment, since the feeding motor 32 is arranged to overlap the twisting mechanism 7A or the feeding motor 32 is arranged at a side in the binding machine main body 10 with respect to the twisting mechanism 7A, it is possible to arrange the feeding motor 32 at a higher position in the binding machine main body 10, as compared to the related-art configuration. Thereby, since it is possible to make a design enabling the magazine 2A to be closer to the wire feeding unit 3A by an empty space of the feeding motor 32, it is possible to reduce a protruding amount of the magazine 2A from the binding machine main body 10. As a result, it is possible to efficiently perform an operation even at a narrow operation place such as a precast concrete factory, so that it is possible to improve the operability.

Also, according to the embodiment, the arrangement of the feeding motor 32 as described above is adopted, so that it is possible to shorten a distance from the trigger 12 to an insertion opening of the curl guide unit 5A for the reinforcing bars S. Thereby, it is possible to easily handle the reinforcing bar binding machine 1A, so that it is possible to further improve the operability.

Also, according to the embodiment, since the trigger 12A is arranged at the position displaced toward the rear side from the position just below the feeding motor 32, it is possible to adjust the center of gravity of the reinforcing bar binding machine 1A to an optimal position.

Although the present disclosure has been described with the embodiment, the technical scope of the present disclosure is not limited to the embodiment. The embodiment can be variously changed or improved without departing from the gist of the present disclosure. Also, one or more requirements described in the embodiment may be omitted.

In the embodiment, the reinforcing bars S are bound using the two wires W. However, the present disclosure is not limited thereto. For example, the present disclosure can be applied to a reinforcing bar binding machine configured to bind the reinforcing bars S by using one wire W or three or more wires W.

1A: reinforcing bar binding machine
3A: wire feeding unit (feeding unit)
4A: guide unit
5A: curl guide unit
7A: twisting mechanism (binding unit)
10: binding machine main body
11A: handle part
12A: trigger
30: feeding motor
80: twisting motor
82: rotary shaft
W: wire

The invention claimed is:

1. A binding machine comprising:

a feeding unit configured to feed a wire and pull back the wire after winding the wire around an object to be bound;

a binding unit which includes a gripping part configured to grip the wire wound around the object to be bound, a twisting motor and a rotary shaft configured to rotate the gripping part with the rotary shaft rotating about a rotary shaft axis, wherein the gripping part is configured to grip the wire wound around the object with the feeding unit and the twisting motor is configured to twist the wire;

a feeding motor configured to rotatively drive the feeding unit;

a binding machine main body configured to accommodate therein the binding unit and the feeding motor, wherein the binding machine main body includes a front side at which the object is bound and a rear side at an opposite end; and a handle part which is provided with a trigger to be pressed by an operator and which extends from the binding machine main body in a direction intersecting with the rotary shaft of the binding unit;

wherein the feeding motor is arranged such that when viewed from a side direction, which is perpendicular to the rotary shaft axis with the binding machine oriented such that the handle part extends downwardly, the feeding motor overlaps with the binding unit such that the feeding motor is in front of or behind the binding unit in said side direction, and wherein the trigger is positioned closer to the rear side of the binding machine main body than the feeding motor, and the twisting motor is positioned closer to the rear side of the binding machine main body than the trigger.

2. The binding machine according to claim 1, wherein:

the trigger is arranged at a position which does not overlap with a line perpendicular to the rotary shaft of the binding unit and passing through the feeding motor, as viewed from the side direction.

3. The binding machine according to claim 2, wherein the feeding motor includes a motor rotary axis which is arranged in a substantially same direction as the rotary shaft of the binding unit, as viewed from the side direction.

4. The binding machine according to claim 1, wherein at least a part of the feeding motor overlaps with a line extending along the rotary shaft axis when viewed in said side direction such that the at least part of the feeding motor is in front of or behind the line in said side direction.

5. The binding machine according to claim 1, further comprising:

a curl guide configured to curl the wire fed by the wire feeding unit around the object, wherein the curl guide includes a first guide part configured to receive the wire from the wire feeding unit, and a second guide part configured to receive the wire from the first guide part, wherein the first guide part is provided at a position facing the second guide part with an axis of the rotary shaft of the binding unit being interposed therebetween, and wherein when viewed from said side direction the feeding motor is arranged above a virtual line passing through a lowest end portion at a guide position of the second guide part and extending in parallel with the rotary shaft axis.

* * * * *